United States Patent [19]

Klein et al.

[11] Patent Number: 5,064,389

[45] Date of Patent: Nov. 12, 1991

[54] ELECTRICAL SLAVE CONNECTOR

[75] Inventors: David A. Klein, Kernersville; Daines M. Self, Jr., Oak Ridge, both of N.C.

[73] Assignee: AMP Incorporated, Harrisburg, Pa.

[21] Appl. No.: 718,532

[22] Filed: Jun. 19, 1991

[51] Int. Cl.[5] ..... H01R 13/00

[52] U.S. Cl. ..... 439/651; 439/746

[58] Field of Search ..... 439/744–752, 439/651, 652

[56] References Cited

U.S. PATENT DOCUMENTS 2,977,562 3/1961 Benson ..... 439/651
4,897,052 1/1990 Priest et al. ..... 439/652

FOREIGN PATENT DOCUMENTS 1187125 4/1970 United Kingdom ..... 439/744
1297452 11/1972 United Kingdom ..... 439/744

*Primary Examiner*—Joseph H. McGlynn
*Attorney, Agent, or Firm*—Allan B. Osborne

[57] ABSTRACT

A slave connector (44,66) for use between a permanently mounted header (32,54) on a printed circuit board (34,56) and a test header (44,66) has been disclosed. The slave contacts (10) have a socket (14) at one end and a pin (16) at another end to permit mating with either plug/pin or cap/receptacle headers.

3 Claims, 7 Drawing Sheets

ELECTRICAL SLAVE CONNECTOR

FIELD OF THE INVENTION

The present invention relates to a slave connector which is between and mated to a permanently mounted connector on a printed circuit board and a test connector that is repeatedly mated thereto during testing.

BACKGROUND OF THE INVENTION

Repeated matings between a connector mounted on a circuit board which will become a component of an end producted and a test connector can result in serious degradation of the circuit board connector to the point where that connector may have to be desoldered from the board and a new one soldered thereto. As is well known, desoldering and resoldering often times causes damage to other components on the board which may not become apparent until after the end product has been passed on to the end user. Accordingly it is now proposed to provide a slave connector which will be mated to the circuit board connector just once and to which the test connector will be repeatedly mated. After completion of the testing, the slave connector is removed from the board.

SUMMARY OF THE INVENTION

According to the present invention, an electrical slave connector is provided which includes a housing and slave contacts therein. The slave contacts have a socket at one end and a pin at the other end so that the slave connector can be mated to either a receptacle header or pin header mounted on a printed circuit board and to receive on the opposite side a test plug or cap header.

DESCRIPTION OF THE INVENTION

Figure 1:
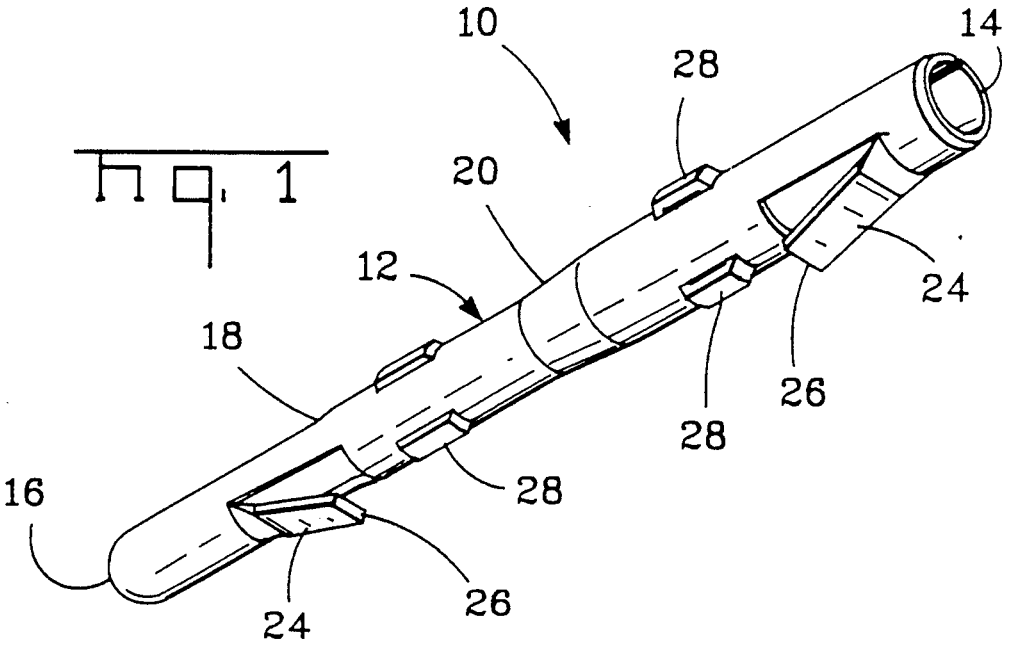
FIGS. 1 and 2 are perspective views taken from different angles of a slave contact of the present invention.
Figure 2:
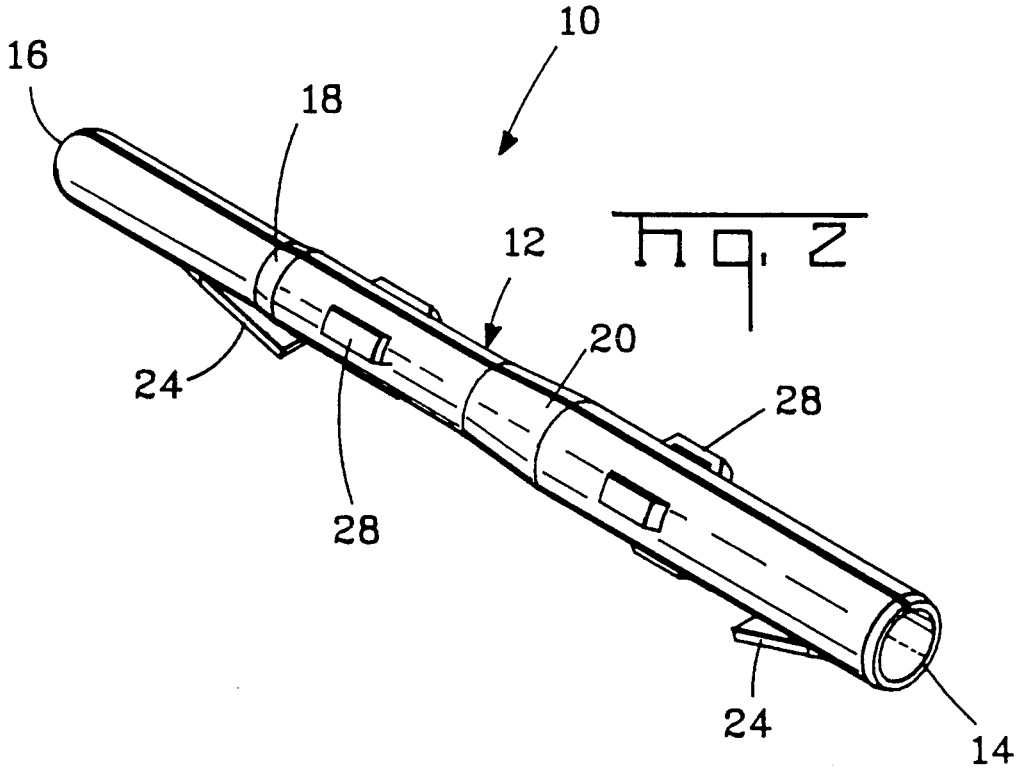
Figure 3:
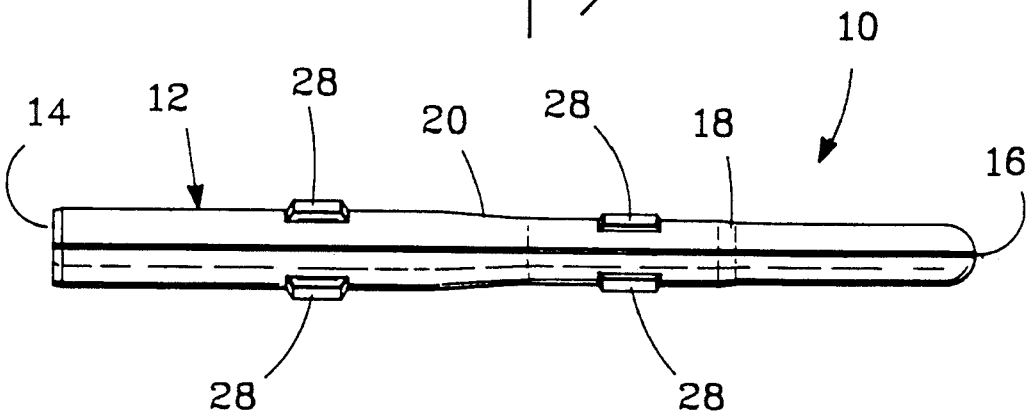
FIGS. 3 and 4 are side views with the contact shown in FIG. 4 turned ninety degrees relative to the contact shown in FIG. 3.
Figure 4:
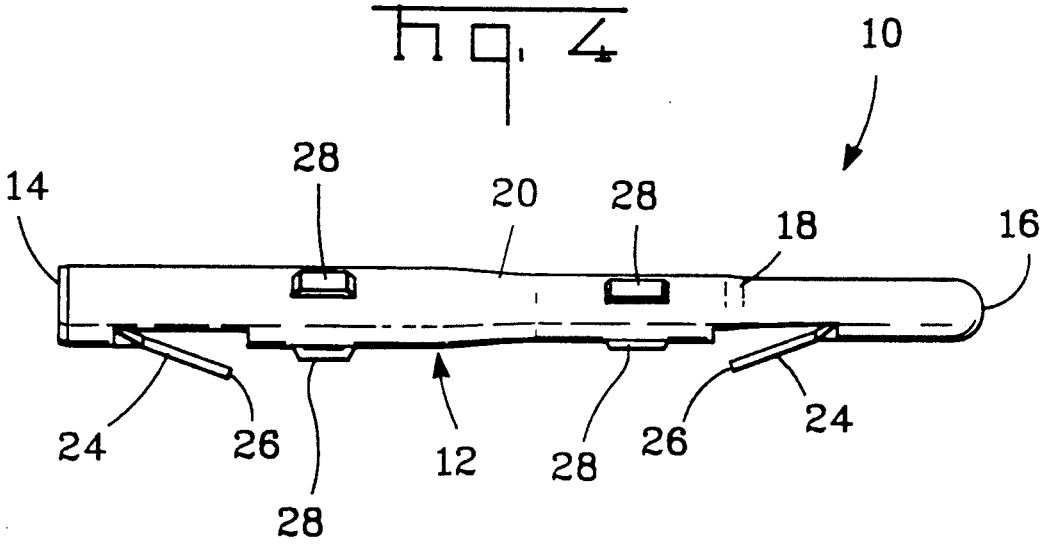

Slave contact 10 as shown in FIGS. 1–4 is preferably stamped and formed from flat stock (not shown) of a suitable conductive material such as pre tin-plated brass. Contact 10 includes shell 12 which is formed at one end into socket 14 and into pin 16 at the other end. As pin 16 is sized to fit into a socket 14, the diameter of shell 12 intermediate the two ends changes with the transition marked by spaced apart first and second cone-shaped areas 18–20 respectively.

Inwardly from socket 14 and pin 16 are locking lances 24 which project obliquely outwardly with tips 26 facing each other. Additionally, two, spaced-apart sets of four ribs 28 each are located inwardly of lances 24. As shown, ribs 28 are spaced ninety degrees apart around the circumference of shell 12.

Figure 5:
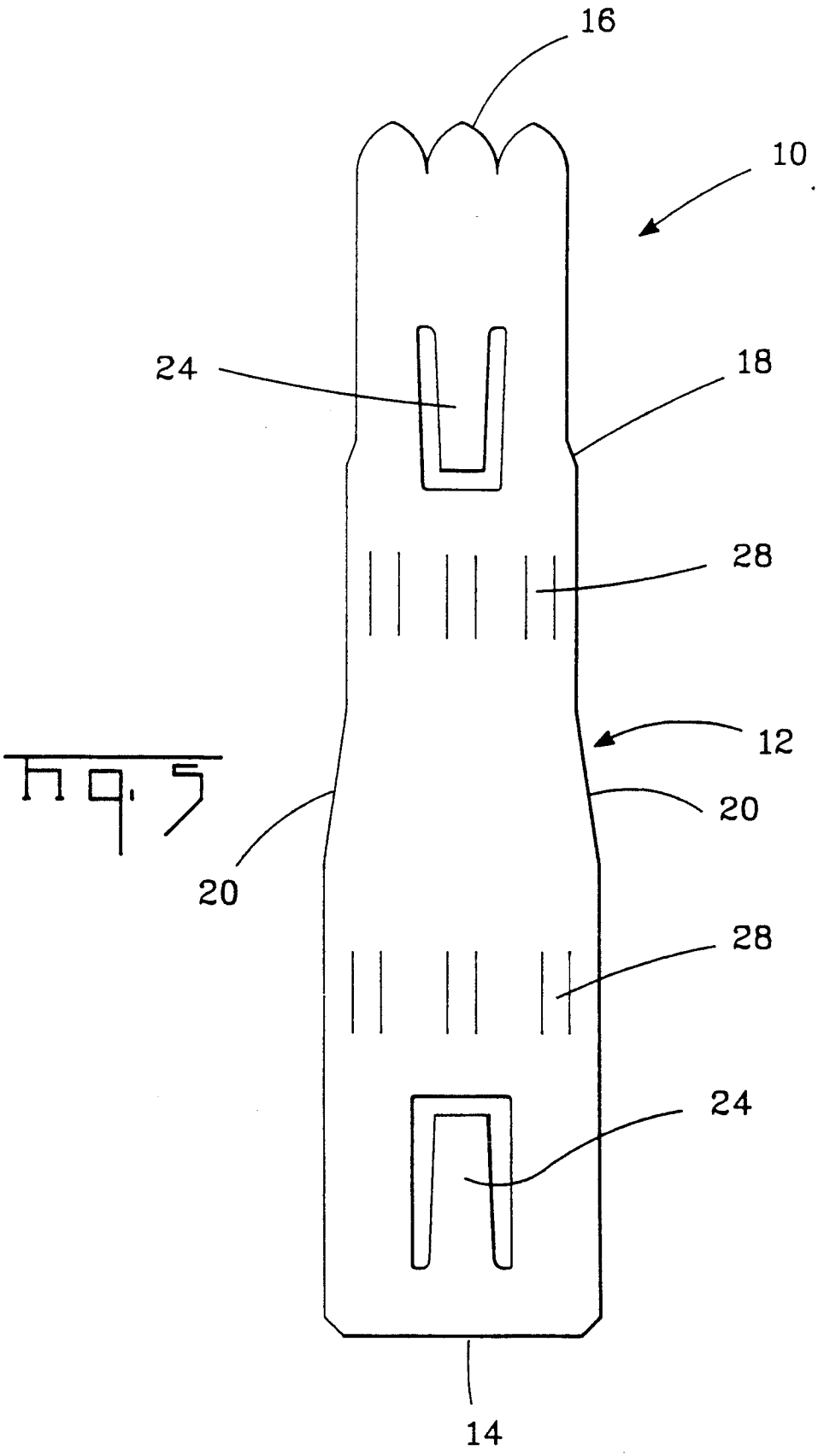
FIG. 5 is a view of a stamped contact prior to being formed.
Figure 7:
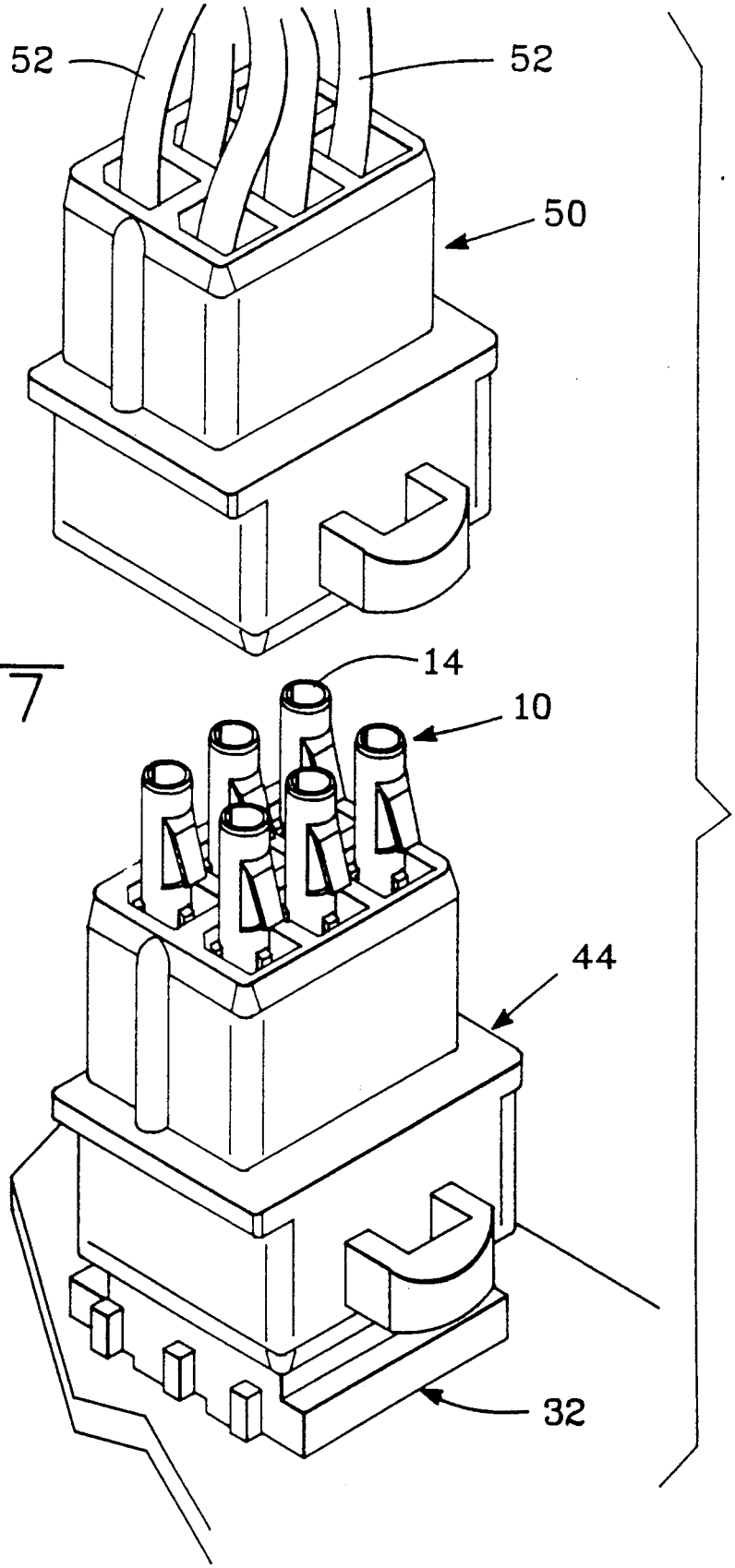
FIG. 7 shows the header and connector mated together and a cap header thereabove with contacts therein terminated to a test equipment harness.

Lances 24 and ribs 28 severed to lock and stabilize contacts 10 in headers 44 and 66 (FIGS. 5 and 7 respectively).

FIG. 5 shows a stamped out contact 10 prior to being formed.

Figure 6:
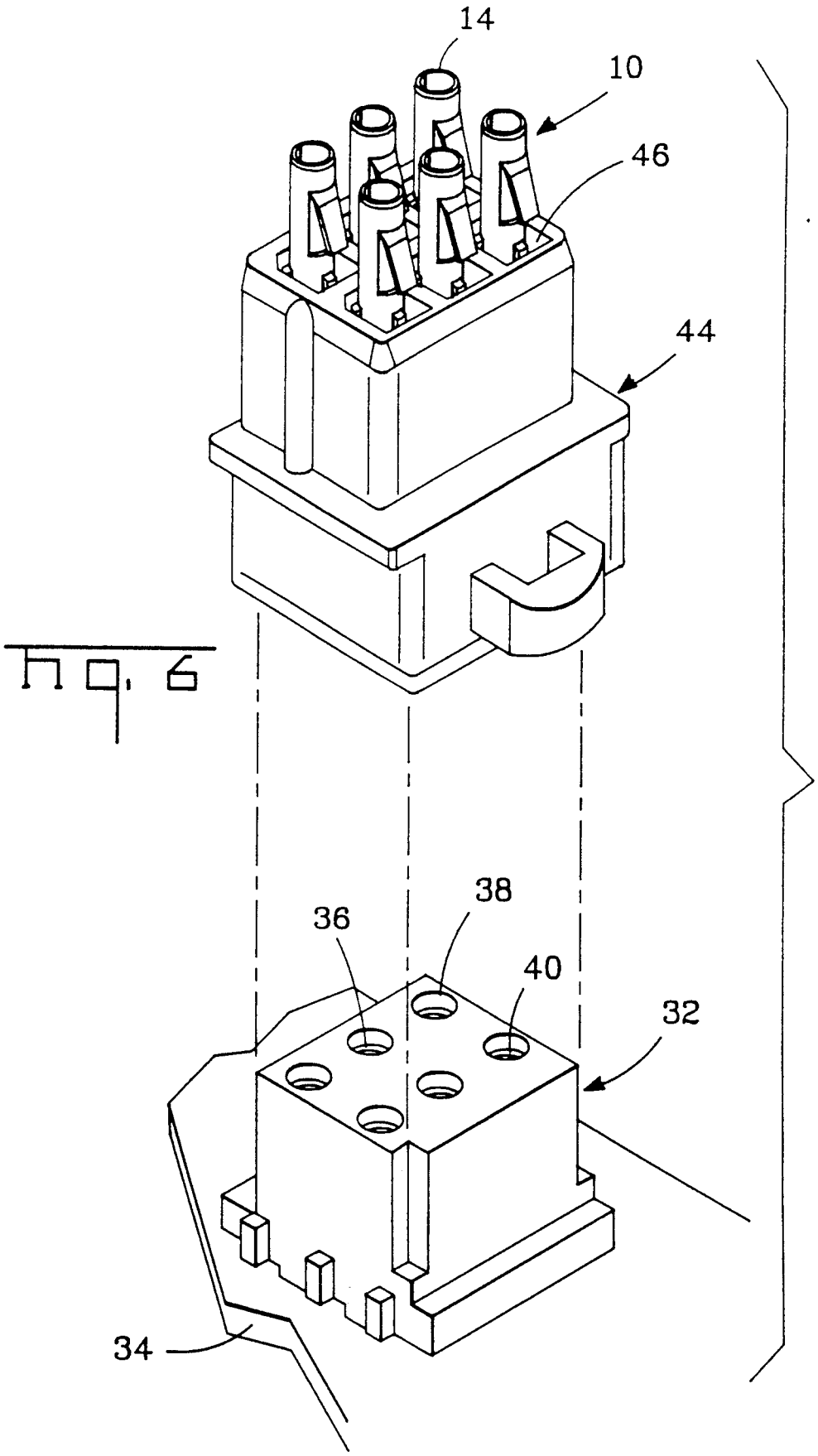
FIG. 6 shows a receptacle header on a circuit board and a slave connector thereabove.

As shown in FIG. 6, a receptacle header 32, such as made and sold by AMP Incorporated of Harrisburg, Penna. under the trademark "MATE-N-LOK", is mounted on circuit board 34. Header 32 carries contacts 36 in cavities 38 with sockets 40 opening outwardly and leads (not shown) engaging circuits on board 34. Slave connector 44, shown above, is also a component of the afore-mentioned "MATE-N-LOK" connector line but carries slave contacts 10 in cavities 46. Contacts 10 are oriented therein so that pins 16 will be received in sockets 40 in header 32. As indicated, connector 44 mates with receptacle header 32.

FIG. 6 shows header 32 connector 44 mated together and a cap header 50 positioned thereabove for mating with slave connector 44. The pin contacts (not shown) within header 50 have pins at one end for mating with sockets 14 in connector 44 and are terminated at another end to wires 52 which go to a test equipment (not shown). Connector 44 remains mated to receptacle header 32 throughout the several tests which require repeated matings. Thus, header 32, which will be part of the end product, sees only one mating while slave connector 44 experiences the required repeated matings.

In the drawing of FIG. 7, pin header 54, mounted on circuit board 56, carries contacts 58 having pins 60 projecting into cavity 62. Pin header 54 is also a component of the aforementioned "MATE-N-LOK" connector line. Shown above header 54 is slave connector 66 loaded with slave contacts 10. In this case sockets 14 (not seen) are accessible in the direction of header 54 so as to mate with pins 60 therein.

Figure 8:
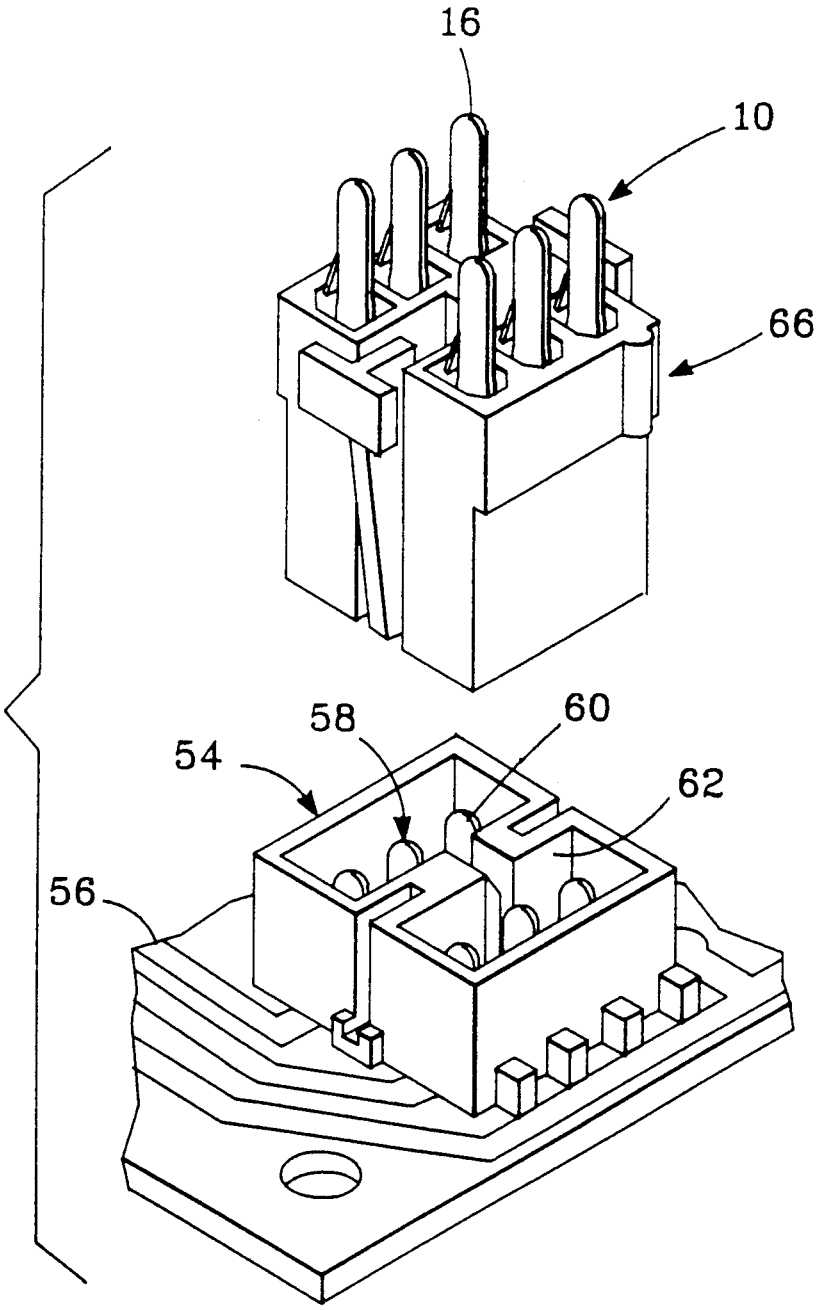
FIG. 8 shows a pin header on a circuit board and a connector loaded with slave contacts thereabove.
Figure 9:
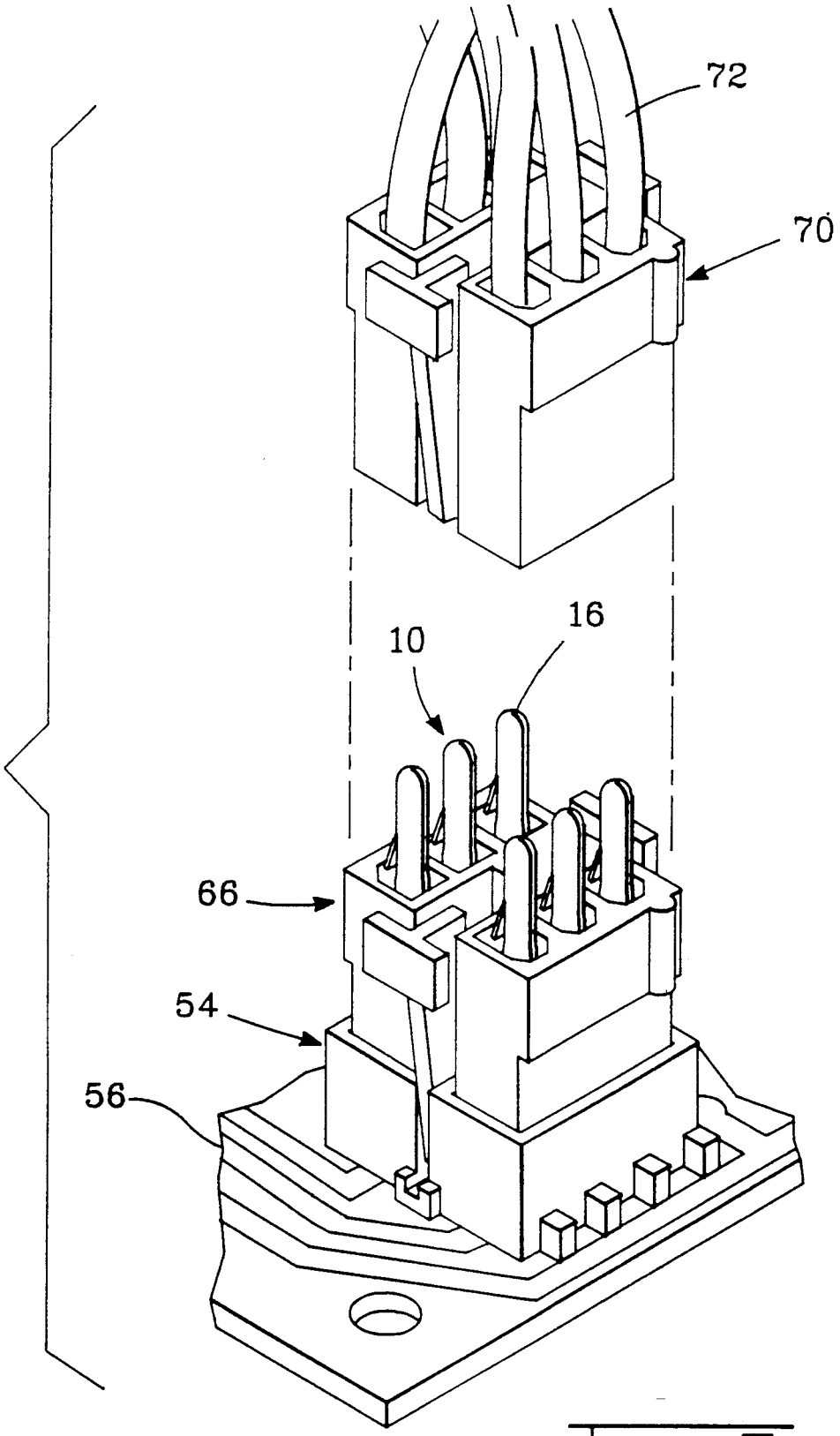
FIG. 9 shows the header and connector of FIG. 8 mated together and a plug header thereabove with contact therein terminated to a test equipment harness.

As seen in FIG. 8, header 54 and slave connector 66 are mated together and plug header 70 positioned thereabove for mating with connector 66. The contacts (not shown) in header 70 include a socket for receiving pins 16 on slave contacts 10 and are terminated to wires 72 which lead to test equipment (not shown). Here again, slave connector 66 will experience repeated matings during the testing while the end product header 54 will have been mated only once.

The slave connectors 44, 66 have been described with reference to circuit board 34. However, connectors 44, 66 and other connectors (not shown) using slave contacts 10 may be used in other testing situations; e.g., wire to wire applications, to obtain the same benefits.

An important advantage of the present invention is that when the slave contacts 10 begin to show signs of wear through repeated matings, they are simply replaced with new ones.

As can be discerned from above, a connector loaded with slave contacts has been described which will take the abuse of repeated matings during testing rather than the connector permanently mounted on a circuit board which will become a component of a product; e.g., a television set. The slave contacts have a socket at one end and a pin at another end for use with either receptacle/cap or pin/plug headers.

We claim:

1. An electrical slave connector for use in repeated mating and unmating applications, comprising:

a housing having cavities extending therethrough; and contacts having a pin at one end and a socket at another end, said contacts further having locking lances projecting obliquely outwardly and located adjacent said socket and said pin with free ends of said lances facing each other, said contacts disposed in said cavities with one end to be mated to either a receptacle header or pin header mounted on a printed circuit board and an opposite end to be mated to either a plug or cap header.

2. The slave connector of claim 1 further including a plurality of ribs spaced circumferentially about said contact at locations adjacent respective said locking lances.

3. The slave connector of claim 1 further including cone-shaped transition areas intermediate said socket and said pin.

* * * * *